US005421422A

United States Patent [19]

Crane et al.

[11] Patent Number: 5,421,422

[45] Date of Patent: Jun. 6, 1995

[54] ROLLER CUTTER MOUNT FOR TUNNELING MACHINE

[76] Inventors: Clayton H. Crane, 530 W. Olympic Way, Seattle, Wash. 98119; John P. Kocab, 2904 Edgehill, Cleveland Heights, Ohio 44118

[21] Appl. No.: 155,014

[22] Filed: Nov. 19, 1993

[51] Int. Cl.[6] ..... E21B 10/10; E21B 10/12

[52] U.S. Cl. ..... 175/363; 175/364

[58] Field of Search ..... 175/361, 363, 364, 366, 175/368, 373; 299/86, 91

[56] References Cited

U.S. PATENT DOCUMENTS

| | | | |
|---|---|---|---|
| 3,749,188 | 7/1973 | Schumacher, Jr. | 175/364 |
| 3,791,705 | 2/1974 | Schimel | 175/363 X |
| 3,851,718 | 12/1974 | Fink | 175/364 X |
| 3,863,994 | 2/1975 | Fink | 175/364 X |
| 4,202,418 | 5/1980 | Waddell | 175/361 |
| 4,234,235 | 11/1980 | Robbins et al. | 299/86 X |

*Primary Examiner*—David J. Bagnell

[57] ABSTRACT

The cutter head of a tunnelling machine is mounted for rotation about the axis of the tunnel and has a face extending on a plane perpendicular to that axis. The cutter head serves as a mount for a plurality of roller cutters, each of which is mounted in a box like saddle member fixed to the cutter head. Each roller cutter includes a frame having a shaft on which the roller cutter is journalled and a pair of end members which fit in recesses on the inside of the saddle member. These recesses open toward the rear of the cutter head to allow removal and replacement of cutters and cutter frames from the rear face of the cutter head. Each cutter frame is held in place by a wedge member on each side of the saddle and wedge members, one on each side, engage mating wedge surfaces on the saddle and the adjacent end member of the cutter frame so that movement of each wedge member by a jack screw in a direction transverse to the axis of the roller forces each end member forwardly in its recess. Suitable clamp bolts extending along an axis parallel to the roller axis extend through the wedge member to make threaded engagement with the saddle to hold the wedge members in place.

8 Claims, 7 Drawing Sheets

ROLLER CUTTER MOUNT FOR TUNNELING MACHINE

BACKGROUND OF THE INVENTION

This invention relates generally to roller cutters of the type mounted on cutter heads of tunnelling or earth-boring machines and more particularly to the mounting of such roller cutters so that they may be removed and replaced from the rear of the cutter head.

Widely used forms of tunnelling machines utilize a radially extending circular cutter head having a diameter equal to that of the tunnel being bored, which is mounted on a supporting frame for rotation about an axis coincident with or parallel to the axis of the tunnel itself. The driving mechanism for rotating the cutter head generally includes one portion which moves axially along with the cutter head and a second portion which is clamped to the tunnel walls so that thrust cylinders between the two portions of the frame work force the rotating cutter head against the tunnel face.

In the case of hard rock and many forms of softer rock, it has been found that the most effective cutter is a roller having a sharp edge or a plurality of hard buttons which compressively engage the rock to cause it to chip and break away in relatively small pieces. Roller cutters, whether of the disk or button type, are generally arranged to roll about an axis which extends parallel to the face of the cutter head and intersects the axis of rotation of the cutter head. While the diameter of cutters may vary somewhat, depending upon the diameter of the cutter head, it is more conventional to increase the number of cutters on larger heads while distributing them over the face of the cutter head in such a way as to balance the thrust forces acting between the cutter head and the adjacent tunnel face while locating them in a pattern that insures that every point on the entire tunnel face will be engaged by at least one cutter during one single rotation of the cutter head.

While such arrangements have been used for many years, they face a problem whenever a cutter becomes damaged or inoperative and must be replaced. Obviously, the larger the cutter head and the more cutters, the greater the likelihood of cutters needing replacement during any given period of operation. The replacement of cutters has been a problem in the past where earlier designs had roller cutters which were mounted on the front face of the cutter head in such a manner that they could be reached for repair or replacement only from the front side of the cutter head. Thus, if service is required on any of the individual cutters, it is necessary to reverse the machine to move the cutter head away from the tunnel face a sufficient distance to provide working room and it is often necessary to have a portion of the cutter head that is removable to allow people and equipment to have access to the front face of the cutter head. As a result, this not only increases the cost of design and manufacture of the cutter head, but also may result in increased cost because of the long down time required for service of this type.

When cutters were mounted on the front face of the cutter head, the mounting was usually accomplished by welding a massive U-shaped saddle member directly to the cutter head with a saddle having a pair of upstanding portions that would mount the ends of a fixed axle or journal assembly on which the cutter wheel is mounted. At one time, tunneling machines of this type were arranged to rotate in only a single cutting direction and this allowed constructions such as those shown in U.S. Pat. Nos. 3,749,188 and 3,851,718, which allowed simplified removal and replacement by a mounting structure that was arranged to take force in one direction only. However, it has been found that because of the tendency of the fixed frame to move and rotate in a direction opposite the direction of the cutter rotation because of the reaction forces from driving the cutter head, newer machines are designed to rotate in either direction so that by periodically changing the direction of rotation of the cutter head, the tendency of the fixed frame to walk around the tunnel is substantially eliminated. However, this required redesign of the cutters to take thrust forces in both directions and typical arrangements are shown in U.S. Pat. Nos. 3,791,705 and 3,863,994.

More recently, it has been proposed that roller cutters can be mounted on a cutter head in such a manner that they can be removed and replaced from the rear face of the cutter head so that the cutter head need not be moved backward from the tunnel face, thereby greatly decreasing the time the tunnelling machine is out of service for cutter repair or replacement. The problem has been, however, to find a suitable means of supporting the roller cutter in place in view of the very high forces involved during cutting. When the cutter is mounted on the front, this is no problem since the end housings on the saddle can be made quite large in size to support in compression the housing ends of the roller assembly frame on which the roller is journalled. If the assembly is merely reversed in direction, then fasteners such as bolts and the like would then be placed in tension which is not satisfactory.

One solution to this problem has been shown in U.S. Pat. No. 4,202,418, granted May 13, 1980, which provides a stationary frame having openings on both the front and rear sides of the cutter head. The cutter assembly includes a stator to support the actual rolling cutter, and the stator is arranged to be inserted into the rear opening and supported by stops near the front opening through which a portion of the cutting edge can project. To hold the stator assembly in position, a plurality of wedge blocks are inserted against each end of the stator and held in place by individual bolts. Because the wedge blocks are inserted perpendicular to the axis of the roller cutter and bear against abutment surfaces on both the stator ends and the frame, the thrust forces on the roller cutter are transmitted through the wedge blocks.

SUMMARY OF THE INVENTION

According to the preferred embodiment of the present invention, the cutter head is mounted for rotation about a central axis parallel to the axis of the tunnel and defines a front face which extends generally in a plane perpendicular to that axis except for curving portions of the outer end which cut the areas near the tunnel wall. The cutter head is formed with a plurality of radially extending slots formed by a pair of uniformly spaced rails, with one of the slots extending transversely across at the axis and others at various angular positions and of shorter lengths near the outer periphery of the cutter head. Each of the individual cutter units, except for the cutters immediately adjacent to the axis of the machine, comprise individual saddle units each supporting a single cutter wheel assembly. The saddle members are essentially in the form of a hollow rectangular box having the top and bottom essentially open and with closed sides and is welded in place on the side rails as a permanent assembly.

On the front side, the saddle has an opening of sufficient size to allow the cutter wheel to project a predetermined distance therethrough so that it can engage the rock face being cut. The rear side of the saddle has a larger opening through which the cutter assembly can be inserted and removed from the rear face of the cutter head. Each cutter assembly mounts a single disk on a hub which in turn is journalled on a shaft so that the disk is free to rotate. The shaft has attached to it at each end a support or end member and the shaft and support members can be considered a cutter frame. Each of the support members includes a pair of V shaped surfaces on one side spaced by a transverse surface and these three surfaces fit into corresponding abutting surfaces formed on a recess on the inside of the saddle member adjacent to the front face. Thus, the whole cutter frame can be inserted from the rear of the saddle member until the V shaped surfaces on the support members engage the corresponding surfaces on the saddle so that the cutter frame is precisely positioned and also held against rotation with respect to the saddle by the support members.

In order to hold the cutter frame in position, and also to absorb the cutting thrust which would tend to force the cutter frame out of the saddle toward the rear, a pair of wedge blocks are used, one for each of the support members. Each of the support members has a slanting cam surface on the side toward the rear of the cutter head and this cam surface extends across the side at an angle to the front face of the cutter head and slopes rearwardly and away from the axis of the cutter shaft toward the end face of the support member. The saddle also has a pair of inclined cam surfaces sloping in a direction opposite the surface on the support member so that they slope forwardly and outwardly toward the sides of the saddle. These two saddle cam surfaces are spaced apart at sufficient distance to allow the support member to pass between them during assembly. Each of the wedge blocks has a surface corresponding to and abuttingly engageable with the cam surfaces on the support member and the saddle and therefore is wider at one end than at the other end. After the cutter frame is assembled and positioned, these wedge blocks can be inserted at one side of the support member with the adjacent cam surface spaced away from the support member and the two surfaces adjacent the cam surfaces on the saddle in engagement. When the wedge blocks are in place, a pair of clamp bolts, which extend parallel to the axis of the shaft, are inserted through elongated openings in the wedge blocks and threaded into the side walls of the saddle. These bolts are partially tightened until the wedge blocks have moved to a position adjacent the walls of the saddle with the cam surfaces on the wedge blocks and the saddle in engagement. The clamp bolts are left loose enough to allow the wedge block to slide laterally in a plane perpendicular to the rotational axis of the cutter until the slanting cam surface engages the mating cam surface on the adjacent support member, and this is easily done by rotating a captive jack screw projecting laterally from the wide end of the wedge block and engaging an abutment surface on the saddle. The jack screws are then tightened to hold the support member in place on the saddle and then the clamp bolts are fully tightened to complete the assembly.

When the cutter head is in operation, the cutting force acting on the disk cutter tends to force the cutter frame toward the rear of the saddle. These thrust forces are transferred from the support member to the wedge block and from the wedge block directly to the saddle through the various cam surfaces and no lateral sheer forces are exerted on the bolts holding the wedge blocks in place. If for any reason while the tunneling machine is in operation with the cutter head against the tunnel face being cut, it is possible to remove and replace a cutter disk without moving the cutter head back along the tunnel axis. All that is necessary is to back off the jack screws and then remove the clamp bolts holding the wedge blocks in place, after which the two wedge blocks can be moved together toward the disk and then moved outward from the saddle. After the wedge blocks have been removed, the cutter frame will readily slide out of the saddle to allow a new one to be inserted in its place.

DETAILED DESCRIPTION OF THE PREFERRED EMBODIMENT

Figure 1:
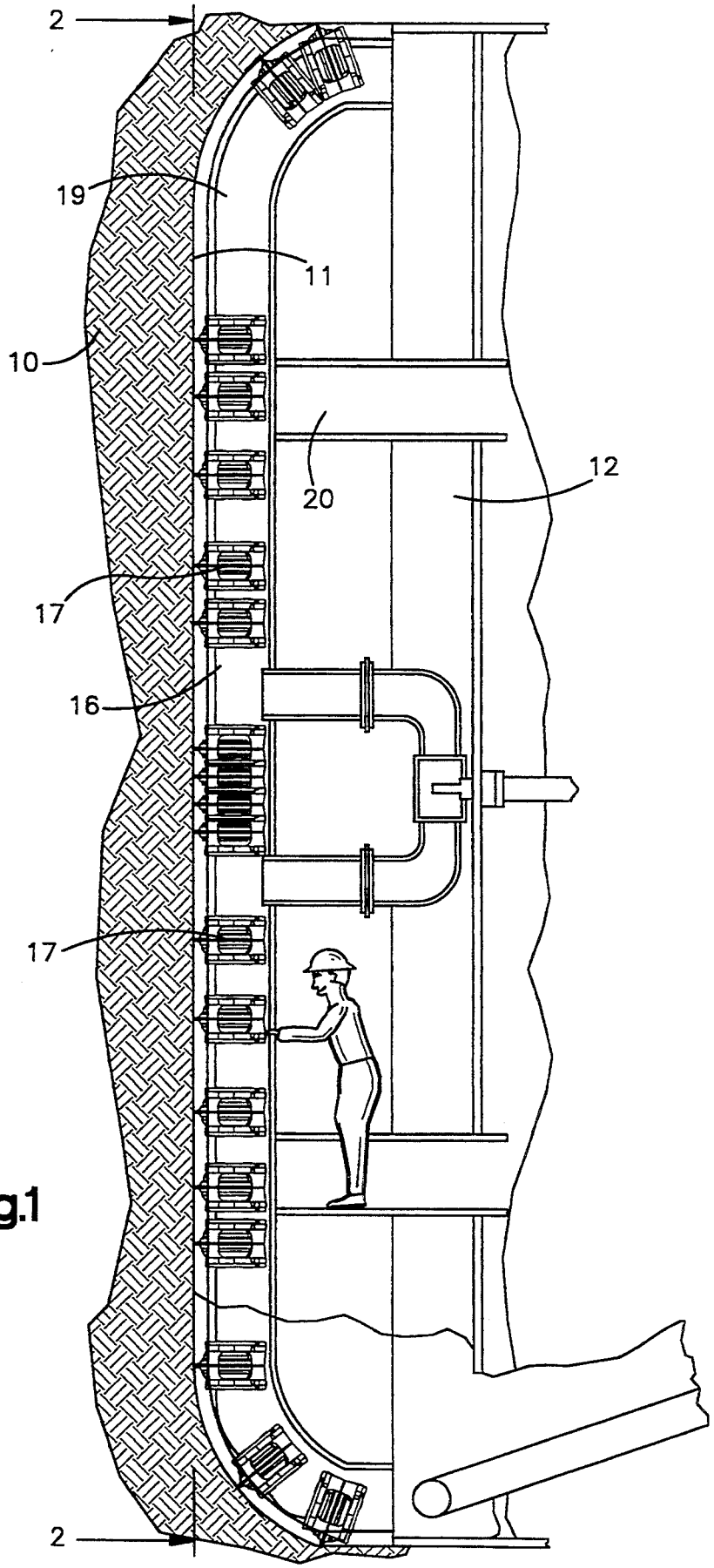
FIG. 1 is a fragmentary cross-sectional view of a tunnel face and a tunneling machine with a cutter head in cutting position.
Figure 2:
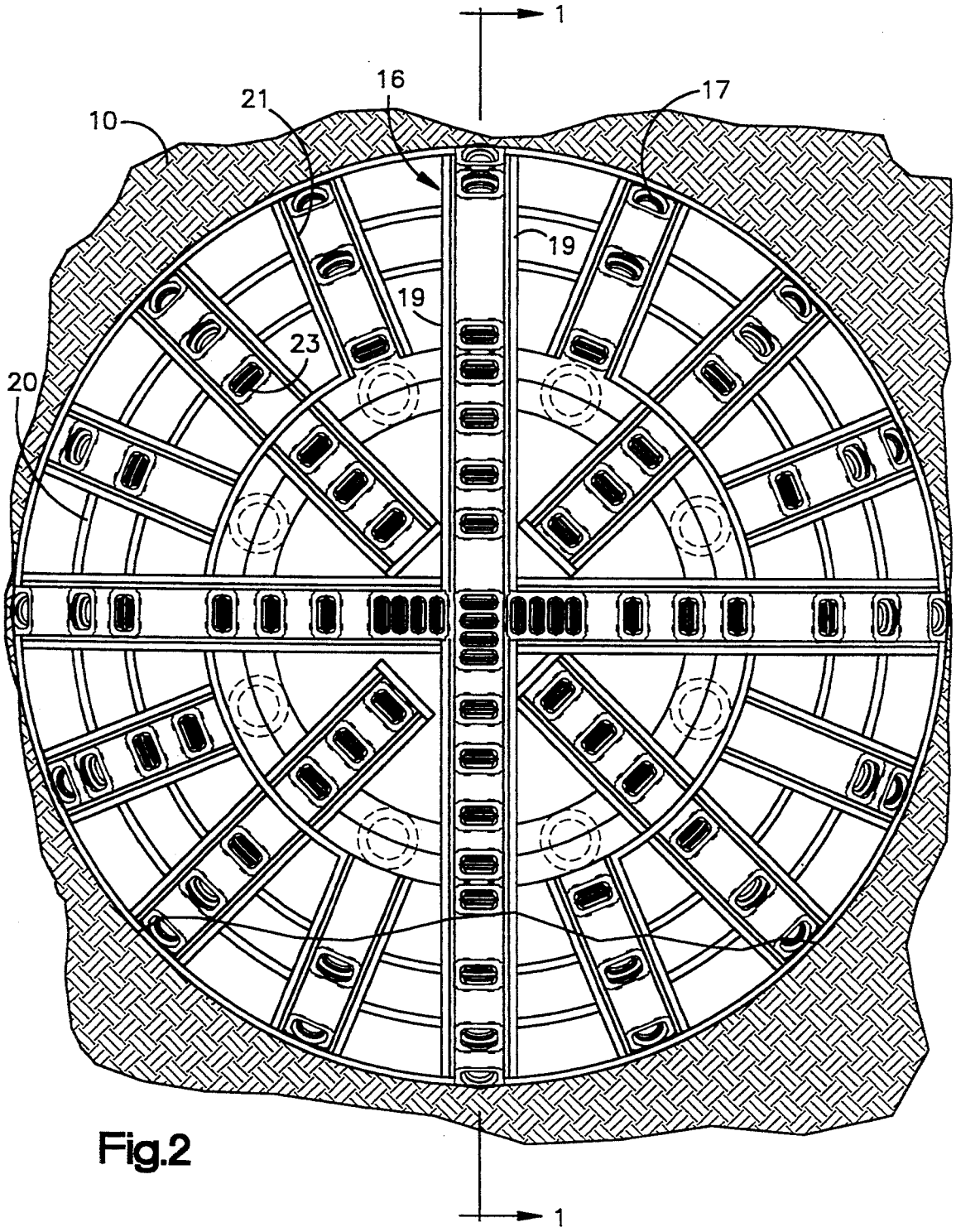
FIG. 2 is a front elevational view taken on line 2—2 of FIG. 1 showing the front face of the cutter head.
Figure 3:
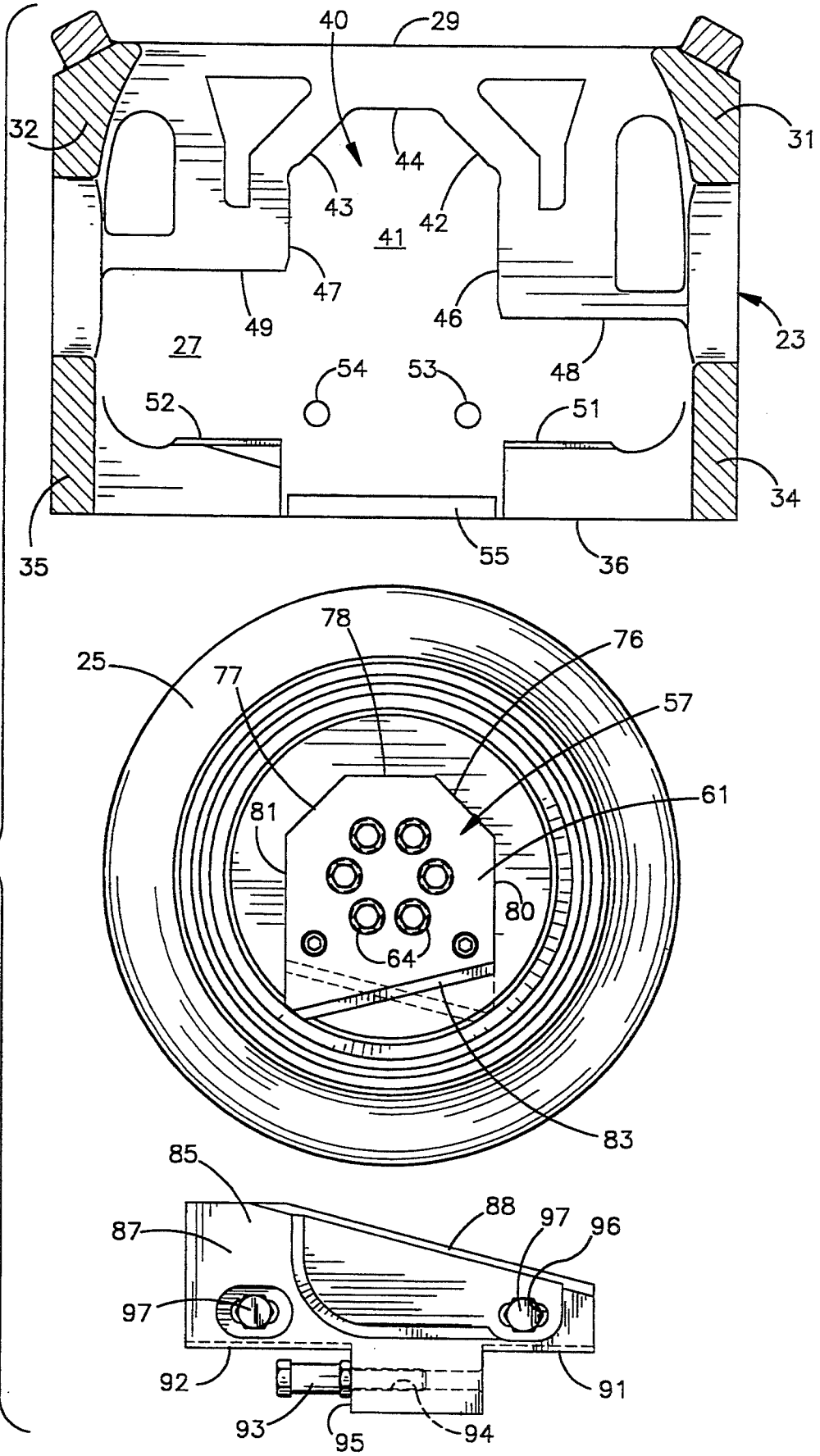
FIG. 3 is an exploded cross-sectional view of a cutter assembly and saddle as mounted on the cutter head.
Figure 4:
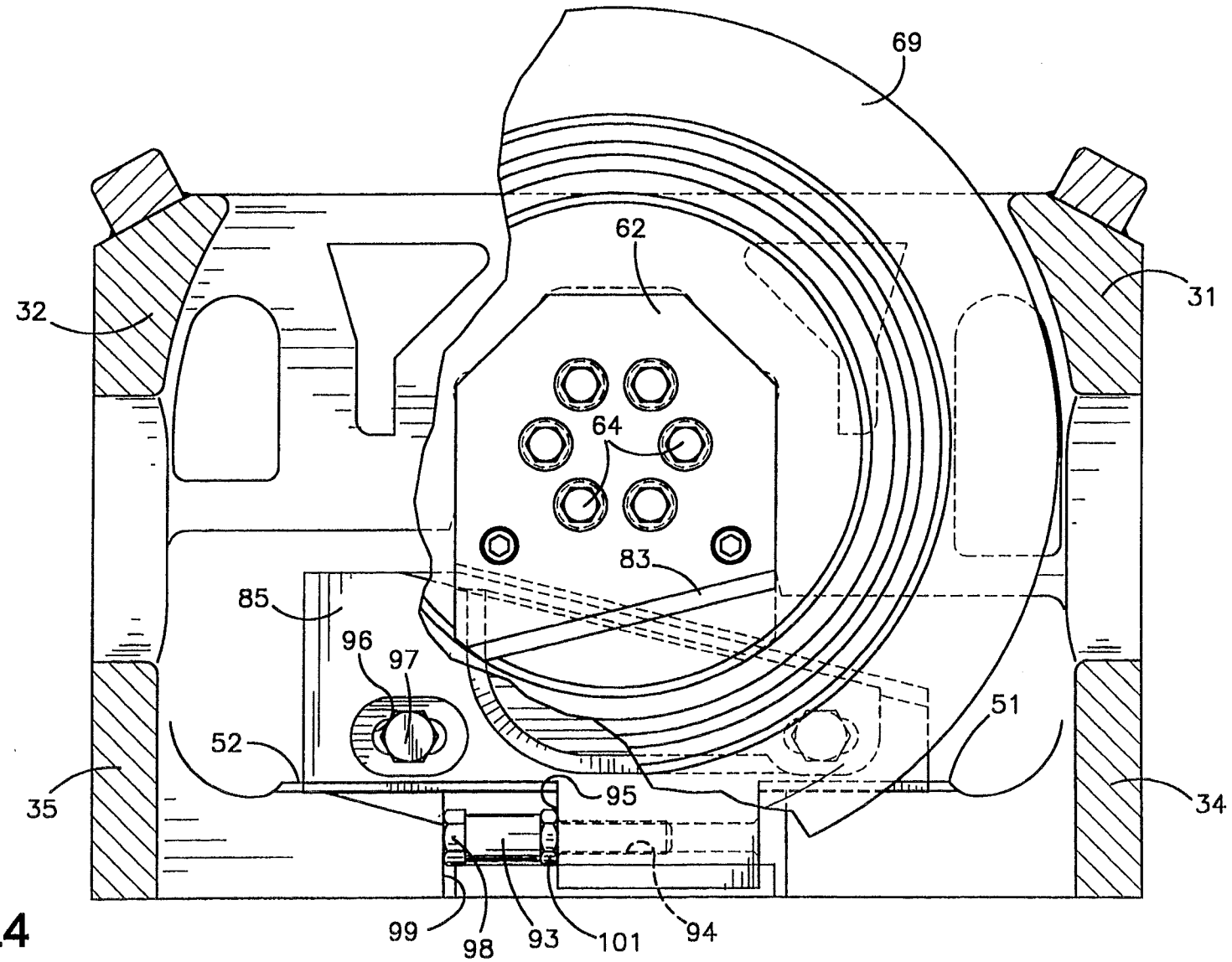
FIG. 4 is a fragmentary cross-sectional view similar to FIG. 3, but showing the members assembled in operating position.
Figure 5:
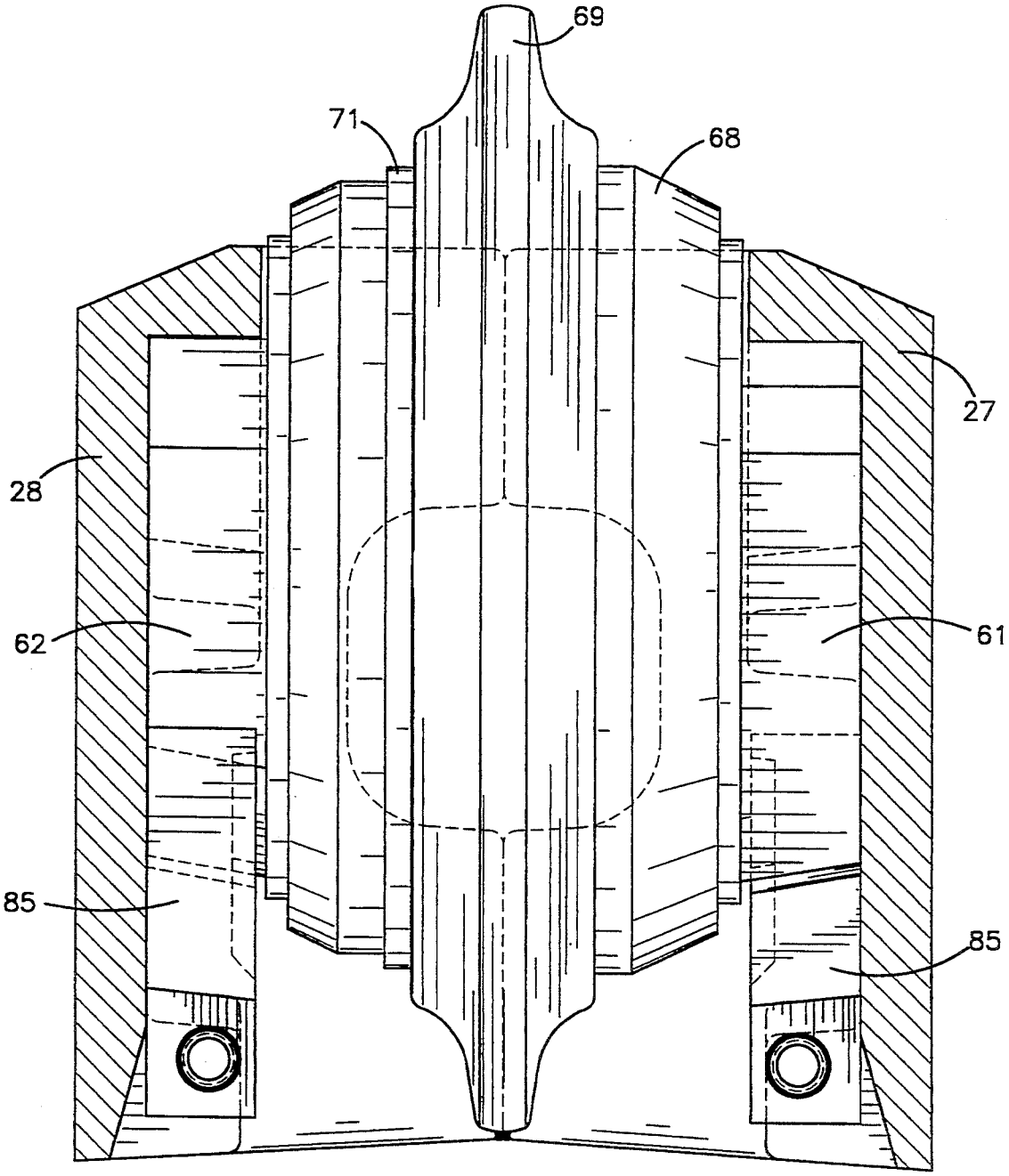
FIG. 5 is another view, partly in section, of the cutter head assembly showing the wedge block mounting.
Figure 6:
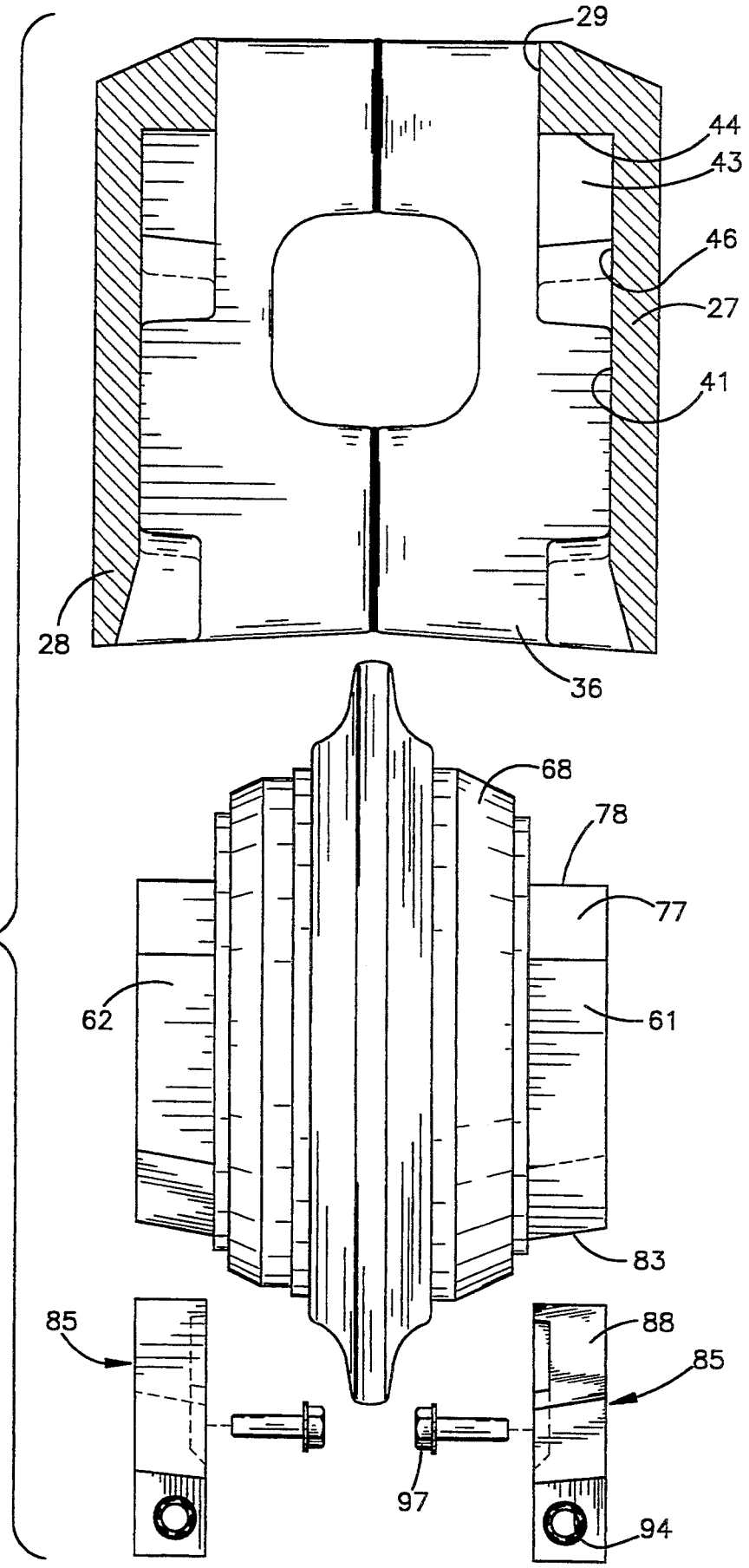
FIG. 6 is another exploded cross-sectional view of the cutter assembly; and, FIG. 7 is a cross-sectional view showing the wedge blocks and the internal construction of the cutter frame.

The present invention is particularly applicable to tunneling machines for boring through hard rock using rotary single disk cutters which are mounted in a spaced array across the face of a rotating cutter head. Thus, as shown in FIG. 1, the rock formation 10 defines a tunnel face 11 where the rock is cut away by a tunneling machine 12 of which only the rotating cutter head 16 is shown, since the remainder of the tunneling machine may be of any of a number of well known configurations which serve to rotate the cutter head 16 about the axis of the tunnel while providing a forward thrust to press the rotating cutter head 16 against the tunnel face 11.

The cutting of the rock is done by a plurality of cutters 17 of the rotating single disk variety which are pressed against the tunnel face 11 and rotate by frictional contact therewith under sufficient pressure to cause the rock to break off in the form of dust or small chips. In order to mount the cutters 17, the cutter head 16 is provided on its face with a plurality of pairs of parallel extending side rails 19 extending radially outward from the axis of the cutter head. These side rails 19 are supported by other structural members 20 so that the cutter head 16 is a strong and rigid member and will not flex under the heavy thrust forces provided by the tunneling machine 12. These side rails 19 define between them slots 21 which serve to support individual saddles 23 for the cutters 17, although near the center of the cutter head there may be special saddles mounting a number of individual cutter wheels side by side. The saddle 23 is constructed to allow the cutter wheel 25, rotatively supported therein to project beyond the saddle 23 and side rails 19 and engage the tunnel face. Of course, other cutter head arrangements for supporting the saddle may be used. For example, on smaller diameter cutter heads, the head may be a solid plate with individual openings for each cutter wheel and the saddle 23 may be welded directly to the rear face of the plate.

The saddles take the form of rectangular open-ended boxes each defined by a pair of parallel extending relatively thick side plates 27 and 28, which are interconnected near the front face of the cutter head by front rails 31 and 32 which, with the side plates, define a front opening 29 adjacent to the front side of the cutter head. The side plates 27 and 28 are also connected by a pair of rear rails 34 and 35 which define a rear opening 36 opened toward the mechanism of the tunneling machine. The saddles are formed with suitable attachment points (not shown) so that they can be welded to the side rails 19 and so that the cutting thrust applied to the saddle 23 is transferred directly to the side rails 19. It will be understood that the saddles 23 are essentially symmetrical about a transverse plane so that the two side plates 27 and 28 are essentially mirror images of each other. Thus, the further construction described herein regarding one side plate 27 is equally applicable to the other side plate 28.

Side plate 27 has a recess 40 formed on its inner side and the front portion of this recess is symmetrical about a center line extending from the front to the rear of the saddle. This recess 40 has a flat wall 41 extending parallel to the outer surface of the side plate and this wall 41 is bounded near the front by a pair of tapered surfaces 42 and 43 which extend perpendicular to the wall 41 and are joined together at the front by a flat surface 44. Side surfaces 46 and 47 extend backward from the tapered surfaces 42 and 43 and join outwardly extending recesses 48 and 49 toward the rear of the side plate. The rearward portions of these recesses 48 and 49 are provided with cam surfaces 51 and 52 which are coplanar and define between them a rear opening 55 which forms part of the rear opening 36 of the saddle. These cam surfaces 51 and 52 slope outwardly and rearwardly away from the wall 41 at about a 5° angle, as will be explained hereinafter. In addition, there are tapped holes 53 and 54 in the recesses 48 and 49 to receive bolts as explained hereinafter.

Figure 7:
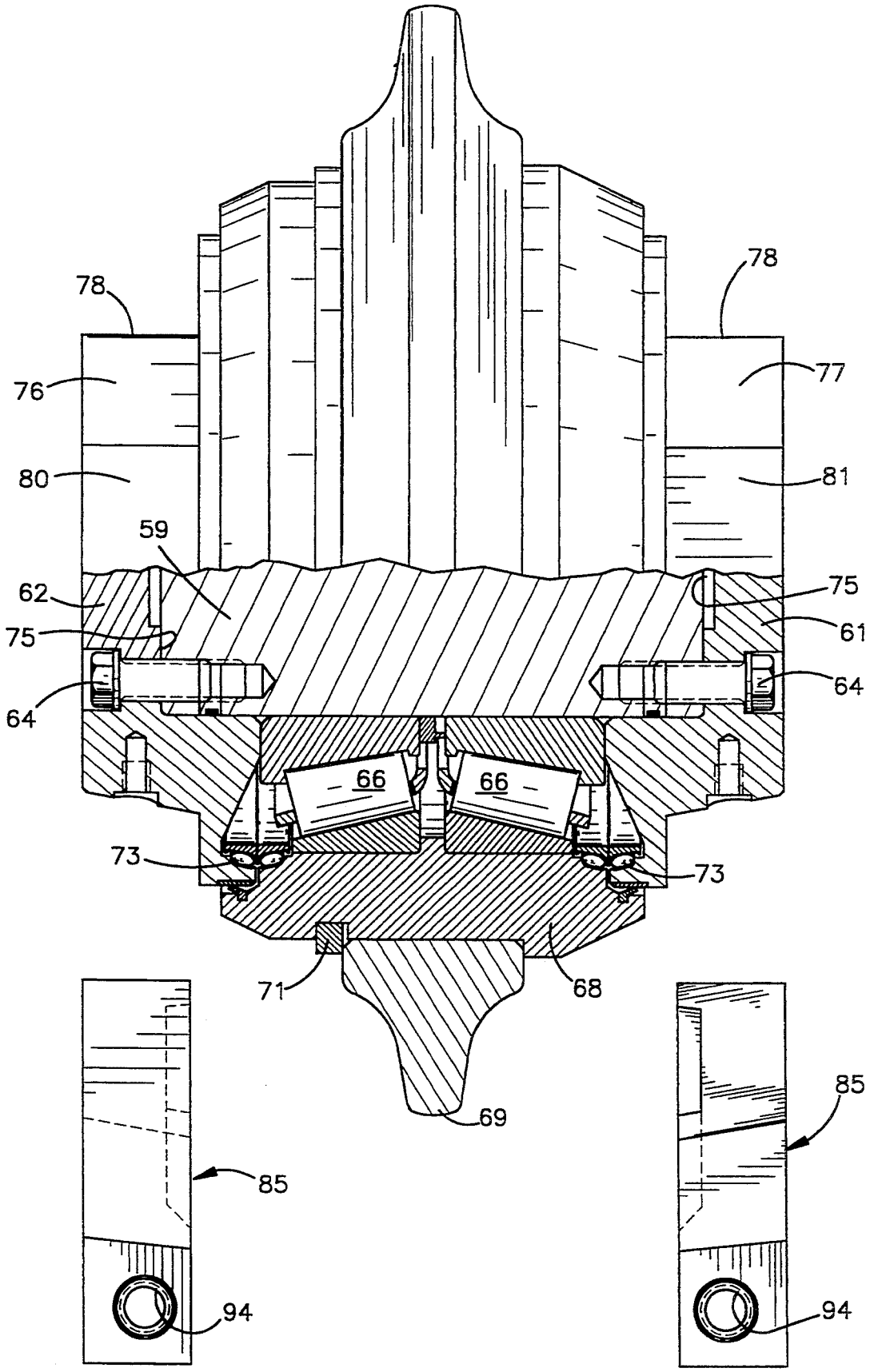

The roller cutter is mounted on a cutter frame 57 which in turn is mounted in the saddle 23. Cutter frame 57 (see FIG. 7) includes a solid shaft member 59 and a pair of end or support members 61 and 62 which may be identical with each other and are secured in place over the ends of the shaft 59 by suitable means such as bolts 64. The shaft 59 serves to mount suitable tapered roller bearings 66 which journal a hub member 68 for rotation about the shaft 59. A suitable cutter ring 69 is mounting on the hub 68 and held in place by a retaining ring 71 and suitable welds as is well known in the art. Suitable seal means 73 are provided between the hub 68 and the end member 61 and 62 to prevent the entry of dirt into the area of the bearings 66 and to prevent leakage of the lubricating oil which surrounds the bearings.

The end members 61 and 62 are preferably identical in shape and in the form of generally flat plates each with a recess 75 for receiving the shaft 59. Each of the end members includes a pair of tapered surfaces 76 and 77 which are adapted to abut against the surfaces 42 and 43 in the recess 40 for positioning the end members and hence the cutter frame and holding them against rotation. An end face 78 extends between the tapered surfaces 76 and 77 and is normally spaced away from the surface 44 in recess 40 to ensure proper engagement between the sets of tapered surfaces. The end member has a pair of parallel sides 80 and 81 which are spaced apart slightly less than the width of the recesses 40 between sides 46 and 47 to allow free movement of the end member 57 in and out of the recesses 40. These sides 80 and 81 extend rearward from the tapered surfaces 76 and 77 beyond the center line of the shaft 59 where they join a slanting cam surface 83. This cam surface slants at an angle of about 15° toward the front of the saddle so that side 81 is longer than side 80. This cam surface also slopes outwardly away from the cutter ring 69 and away from the axis's shaft 59 preferably at a non-locking angle such as 5° for engagement with the adjacent locking wedge member which holds the cutter frame in place.

The locking wedge members 85 are identical and fit within the recesses 40 behind the end members 61 and 62. Each wedge member 85 has an outer side 86 adjacent to the wall 41 and an inner side facing the cutter ring 69. On its forward edge, the wedge member has a slanting cam surface 88 which is parallel to and mates with the slanting cam surface 83 on the adjacent end member in surface abutting contact. Likewise, each wedge member 85 also has a pair of spaced cam surfaces 91 and 92 on the rearward side which are parallel to and engage the cam surfaces 51 and 52 formed in the outwardly extending recesses 48 and 49. To hold the wedge member 85 in place, it has a pair of elongated bolt holes 96 which align with the tapped holes 53 and 54 in the saddle and a pair of bolts 97 extend through the bolt holes 96 to engage the saddle and hold the wedge member in place. Lateral wedging movement of the wedge member is provided by a jack screw 93 which engages a threaded bore 94 in face 95 of wedge member 85. Jack screw 93 has a wrench receiving head 98 which abuts against a face 99 on saddle 23, so that as the jack screw is rotated, the wedge member 85 is moved laterally along the cam surfaces 51–91 and 52–92. Moving the wedge member away from face 99 causes the slanting cam surface 88 to engage the slanting surface 83 and force the end member 61 forward until the tapered surfaces 76 and 77 are in tight engagement with the tapered surfaces 42 and 43 on the saddle. A jam nut 101 threaded on jack screw 93 engages face 95 to lock the jack screw in position.

When the cutter frame 57 is assembled to the saddle, it is moved forward until the end member abuts the bottom of the recess 40. Each wedge member, with the jack screw retracted, is placed in position and the clamp bolts threaded in place. These bolts are tightened until the wedge member surface 86 abuts the recess surface 41 but are left lose enough that the jack screw can move the wedge member. The jack screw is then extended until all of the cam surfaces are in tight engagement, after which the jam nut 101 is tightened and the clamp bolts 97 are fully tightened.

The saddles 23 are normally welded to the side rails 19 so that the saddle 23 are rigidly and permanently held in place since normally little damage occurs to the saddle itself during the tunneling operation. Naturally, since it is the cutter ring 69 that engages the tunnel face, this ring 69 may require service or replacement periodically during the boring of the tunnel. In order to allow access to the cutter ring, the entire cutter frame 57 can be removed from the rearward face of the saddle 23. To do this, it is only necessary to loosen the jam nuts 101 and retract the jack screws 93, after which it is possible to remove the four clamp bolts 97 and hence the two wedge members 85. The complete cutter frame 57 can then be removed from the saddle with the end members 61 and 62 passing outwardly through the recesses 40.

It should be noted that the tapered surfaces toward the front of the saddle including the surfaces 76 and 77 on the end members and the mating surfaces 42 and 43 basically serve to prevent reaction torque from rotating the end members, since the cutting forces acting against the cutter ring 69 actually tends to force these surfaces apart. However, movement of the end members is prevented by the wedge members 85 and the thrust against the cutter ring is thus transferred through the slanting surface 83 on each end member to the mating slanting cam surface 88 on the wedge member and hence from the wedge member through its cam surfaces 91 and 92 to the mating cam surfaces 51 and 52 at the rear of the recess. Thus, the wedge member is held tightly in place with its outer side 86 in abutment with the wall 41, and the bolts 97 provide additional security against movement of the wedge member 85.

It will be seen that the foregoing structure provides a roller cutter for a tunnel boring machine cutter head which can easily be removed and replaced from the rear face of the cutter head merely by removing and replacing the four bolts and two wedge members and that all thrust forces are transferred from the cutter ring to the saddle entirely through members in compression rather than tension.

Although the preferred embodiment of the invention has been shown and described in detail, it is recognized that other modifications and rearrangements may be resorted to without departing from the scope of the invention as defined in the claims.

What I claim is:

1. A cutter head for a tunnelling machine having a generally radially extending front face and a rear face, said cutter head being mounted for rotation about an axis extending parallel to the axis of the tunnel, a plurality of roller cutters mounted on said cutter head, each of said roller cutters comprising a saddle rigidly mounted on said cutter head and defining front and rear openings, a cutter frame insertable through said rear opening, first mating abutment means on said frame and said saddle adjacent said front opening limiting movement of said frame toward said front face and preventing rotation of said cutter frame with respect to said saddle, said frame defining a roller axis extending generally parallel to said cutter head faces, a roller cutter journalled on said frame to rotate about said roller axis and having a peripheral edge extending through said front saddle opening, said frame including a pair of end members, one on each side of said roller cutter, each of said end members and an adjacent portion of said saddle having aligned and opposed spaced wedge surfaces sloping and converging at an angle in the direction transverse to said roller axis and away from said roller cutter, a pair of locking wedge members, one on each side of said roller cutter, having aligned and opposed spaced wedge surfaces extending parallel to and engageable with the adjacent wedge surfaces on said end frames an said saddle, said mating wedge surfaces on each of said end members and the adjacent wedge member being slanted toward the cutter head face, and clamp bolt means securing said locking wedge members to said saddle.

2. A cutter head as set forth in claim 1, wherein said first mating abutment means comprise V-shaped surfaces on said saddle and meeting V-shaped surfaces on each of said end members.

3. A cutter head as set forth in claim 1, including jack screw means to move said wedge members in a plane normal to said roller axis in a direction parallel to said cutter head frame.

4. A cutter head as set forth in claim 3, wherein said jack screw means extends between said saddle and said wedge member.

5. A cutter head for a tunnelling machine having a generally radially extending front face and a rear face, said cutter head being mounted for rotation about an axis extending parallel to the axis of the tunnel, a plurality of roller cutters mounted on said cutter head, each of said roller cutters comprising a saddle rigidly mounted on said cutter head, said saddle having a pair of parallel side plates and means connecting said side plates, said saddle defining front and rear openings, each of said side plates having a recess on the inner side extending from said rear opening, a cutter frame insertable through said rear opening, said frame including a shaft defining a roller axis extending generally parallel to said cutter head faces, a roller cutter journalled on said shaft to rotate about said roller axis an having a peripheral edge extending through said front saddle opening, said frame including a pair of end members, one on each side of said roller cutter, each of said end members fitting in the adjacent side plate recess, first mating abutment means on each of said end members and the adjacent recess adjacent said front opening limiting movement of said frame toward said front face and preventing rotation of said cutter frame with respect to said saddle, each of said end members and an adjacent portion of said saddle having aligned and opposed spaced wedge surfaces sloping and converging at an angle in the direction transverse to said roller axis and away from said roller cutter, a pair of locking wedge members, one on each side of said roller cutter, having aligned and opposed spaced wedge surfaces extending parallel to and engageable with the adjacent wedge surfaces on said end frames and said saddle, jack screw means to move said wedge members in said direction transverse to said roller axis, and clamp bolt means securing said locking wedge members to said saddle side plates.

6. A cutter head as set forth in claim 5, wherein said jack screw means moves said wedge members in a plane parallel to said saddle side plates.

7. A cutter head as set forth in claim 5, wherein said mating wedge surfaces on said wedge member and on said saddle are each at least two in number and are spaced apart by a distance greater than the width of said end member.

8. A cutter head as set forth in claim 7, wherein said saddle wedge surfaces are located in outwardly extending recesses, one on each side of said first mentioned recess.

* * * * *

UNITED STATES PATENT AND TRADEMARK OFFICE

CERTIFICATE OF CORRECTION

PATENT NO. : 5,421,422

DATED : June 6, 1995

INVENTOR(S) : Crane et al.

It is certified that error appears in the above-indentified patent and that said Letters Patent is hereby corrected as shown below:

On title page, after "[76] Inventors: ...", after the address of the last inventor, insert the following section:

--[73] Assignee: Boretec, Inc., Solon, Ohio--.

Signed and Sealed this

Twenty-third Day of April, 1996

Bruce Lehman

*Attest:*

BRUCE LEHMAN

*Attesting Officer*

*Commissioner of Patents and Trademarks*